US010174988B2

(12) United States Patent
Heinrich et al.

(10) Patent No.: US 10,174,988 B2
(45) Date of Patent: Jan. 8, 2019

(54) MOBILE REFRIGERATION CABINET

(71) Applicant: InterMetro Industries Corporation, Wilkes-Barre, PA (US)

(72) Inventors: Wilhelm Heinrich, White Haven, PA (US); Willard Sickles, Dalton, PA (US); Douglas Kaminski, West Wyoming, PA (US); Ambarish Walimbe, Pune (IN); Kyle Schumaker, Greer, SC (US)

(73) Assignee: INTERMETRO INDUSTRIES CORPORATION, Wilkes-Barre, PA (US)

( * ) Notice: Subject to any disclaimer, the term of this patent is extended or adjusted under 35 U.S.C. 154(b) by 114 days.

(21) Appl. No.: 15/286,724

(22) Filed: Oct. 6, 2016

(65) Prior Publication Data

US 2017/0131017 A1 May 11, 2017

Related U.S. Application Data

(63) Continuation of application No. 14/171,188, filed on Feb. 3, 2014.

(Continued)

(51) Int. Cl.
*F25D 11/00* (2006.01)
*F25D 19/00* (2006.01)

(Continued)

(52) U.S. Cl.
CPC ..... *F25D 19/003* (2013.01); *F25D 11/003* (2013.01); *F25D 19/02* (2013.01);

(Continued)

(58) Field of Classification Search
CPC ..... F25D 19/02; F25D 19/003; F25D 23/006; F25B 2500/13; F04B 39/0044
See application file for complete search history.

(56) References Cited

U.S. PATENT DOCUMENTS 1,880,280 A * 10/1932 Replogle ..... F25D 23/006 200/82 R
2,634,069 A * 4/1953 Drake ..... F16F 15/04 248/583

(Continued)

FOREIGN PATENT DOCUMENTS

BE 490971 9/1949
EP 1669707 6/2006

(Continued)

OTHER PUBLICATIONS

Extended European Search Report for EP 14745650.3, dated Sep. 23, 2016; EPO.

(Continued)

*Primary Examiner* — Christopher R Zerphey
(74) *Attorney, Agent, or Firm* — Harness, Dickey & Pierce, P.L.C.

(57) ABSTRACT

A mobile refrigeration cabinet that includes a refrigerated section, a non-refrigerated section that has an aperture in a side thereof, and an opening between the refrigerated and non-refrigerated section. The aperture allows access to the non-refrigerated section. The cabinet may include a movable tray disposed in the non-refrigerated section that is movable through the aperture, and a refrigeration system removably mounted on the movable tray. A biasing system is configured to engage the movable tray so as to bias the refrigeration system towards the opening between the refrigerated section and the non-refrigerated section such that a portion of the refrigeration system sealingly engages the opening.

13 Claims, 15 Drawing Sheets

Related U.S. Application Data

(60) Provisional application No. 61/760,931, filed on Feb. 4, 2013, provisional application No. 61/792,558, filed on Mar. 15, 2013.

(51) Int. Cl.
*F25D 19/02* (2006.01)
*F25D 23/00* (2006.01)
*F25D 29/00* (2006.01)

(52) U.S. Cl.
CPC ..... *F25D 23/006* (2013.01); *F25D 29/003* (2013.01); *F25B 2500/13* (2013.01); *F25D 2400/20* (2013.01); *F25D 2400/38* (2013.01)

(56) References Cited

U.S. PATENT DOCUMENTS

| | | | | |
|---|---|---|---|---|
| 2,923,505 | A | 2/1960 | Immendorf | |
| 3,059,882 | A | 10/1962 | Staar | |
| 4,114,845 | A | 9/1978 | Weisenberger | |
| 4,222,555 | A * | 9/1980 | Eimen | B60N 2/502 248/550 |
| 4,736,555 | A | 4/1988 | Nagare et al. | |
| 4,858,865 | A | 8/1989 | Schrepfer | |
| 5,070,708 | A | 12/1991 | Malosh et al. | |
| 6,015,131 | A | 1/2000 | Brewer, III | |
| 6,773,172 | B1 | 8/2004 | Johnson et al. | |
| 7,175,150 | B2 * | 2/2007 | Chi | F16F 3/10 248/562 |
| 7,325,412 | B2 * | 2/2008 | Yun | A47B 91/022 248/188.4 |
| 2002/0124590 | A1 | 9/2002 | Rudick | |
| 2005/0257554 | A1 | 11/2005 | Yun et al. | |
| 2005/0257555 | A1 | 11/2005 | Yun et al. | |
| 2005/0257556 | A1 | 11/2005 | Lee et al. | |
| 2005/0262863 | A1 | 12/2005 | Iguchi et al. | |
| 2006/0107677 | A1 | 5/2006 | Iguchi et al. | |
| 2009/0045680 | A1 | 2/2009 | Litch et al. | |
| 2010/0083684 | A1 | 4/2010 | Moon | |
| 2014/0202199 | A1 | 7/2014 | Hirai et al. | |

FOREIGN PATENT DOCUMENTS

| | | |
|---|---|---|
| GB | 2446301 | 8/2008 |
| JP | 2002021728 | 1/2002 |

OTHER PUBLICATIONS

J.S. Lamancusa, Vibration Isolation, Penn State University, May 28, 2002, pp. 12.1-12.14.

International Search Report and Written Opinion in International Application No. PCT/US2014/014424, dated May 20, 2014.

* cited by examiner

MOBILE REFRIGERATION CABINET

CROSS-REFERENCE TO RELATED APPLICATIONS

This application is a continuation of U.S. patent application Ser. No. 14/171,188 filed on Feb. 3, 2014. This application claims the benefit of U.S. Provisional Patent Appln. No. 61/760,391, filed Feb. 4, 2013, and U.S. Provisional Patent Appln. No. 61/792,558, filed Mar. 15, 2013, which are hereby incorporated by reference in their entirety. The entire disclosure(s) of (each of) the above application(s) is (are) incorporated herein by reference.

BACKGROUND

1. Field of the Invention

The present invention relates generally to mobile refrigeration cabinets.

2. Background

For relatively large events where food and drink are served, it is often not possible for a kitchen to prepare enough servings from scratch to feed the attendees within a reasonable time period. Accordingly, food and drink items are prepared ahead of time and stored until served. To ensure that items do not perish or reach an inappropriate temperature, they are typically stored in a mobile refrigeration cabinet. The food is prepared and loaded into the refrigerated cabinets, which are plugged into an electrical outlet so that the internal refrigeration system can cool the interior of the cabinet. When the food is ready to be served, the refrigerated cabinets are unplugged and moved to a more convenient location for service.

These conventional units, however, have several drawbacks. First, moving the refrigerated cabinets inevitably results in bumps and vibrations which can harm the refrigeration system. Even with normal use, repeated exposure to bumps and vibrations can cause a refrigeration system to breakdown. Conventional units have attempted to remedy this deficiency by using caster-mounted springs. It has been found that doing so, however, makes the conventional cabinets unstable. Since a mobile refrigeration cabinet may weigh well over four hundred pounds, and are typically tall, such instability is potentially dangerous.

While it may be possible to repair a refrigeration system when is breaks, the cause of the failure must first be diagnosed. In conventional mobile refrigeration cabinets, this requires a time-consuming disassembly of the refrigeration cabinet to access the refrigeration system. Once disassembled, a series of diagnostic tests are required to determine the precise cause of failure, and then, if possible, a repair is made. However, if the necessary parts are not on hand, the refrigeration cabinet is kept out of service for a prolonged period of time. Thus, when a primary refrigeration cabinet breaks down, there is a significant loss of time and consumption of human resources.

Another drawback of many conventional mobile refrigeration cabinets, is that they fail to address stratification within the refrigerated space that can lead to an undesirable temperature differential. Specifically, once such a conventional mobile refrigeration cabinet is unplugged from its power source, the refrigeration system stops circulating air within the refrigerated space. Over time, cooler air migrates to the bottom of the refrigerated section, while warmer air migrates to the top. As a result, items stored at the top of the refrigerated section are warmer than those stored at the bottom, leading to inconsistencies among items to be served. Stratification, therefore, reduces the amount of time the items can be stored in the mobile refrigeration cabinet.

Consequently, it would be advantageous to provide a mobile refrigeration cabinet which addresses the problems arising from stratification. It would also be advantageous to provide a mobile refrigeration cabinet where the refrigeration system is protected from harmful bumps and vibrations. In addition, it would be advantageous to design a mobile refrigeration cabinet where the refrigeration system is easily accessible. Still further, it would be advantageous to design a mobile refrigeration cabinet where the refrigeration system is a single modular unit, which can be easily removed and replaced with another refrigeration system.

SUMMARY

The present invention provides a mobile refrigeration cabinet with a removable refrigeration system.

In one embodiment, the mobile refrigeration cabinet includes a refrigerated section, a non-refrigerated section, a refrigeration system, a movable tray, and a plurality vibration damping elements. The refrigeration system is a modular unit provided on the movable tray, which can be moved relative to or removed from the non-refrigerated section through an access panel. The movable tray may also be removable from the mobile refrigeration cabinet, or slide to an external position where the refrigeration system can be removed. The plurality of vibration damping elements contact the underside of the movable tray and provide a biasing force towards the refrigerated section. Preferably, vibration damping elements are mounted at the base of the non-refrigerated section. The plurality of vibration damping elements also absorb the energy from an applied force transferred from the casters (or other ground contact point). This causes the movable tray to move relative to the cabinet. Examples of preferred types of vibration damping elements include springs, rubber mounts, and wedges.

The vibration damping elements may be manipulated to cause the refrigeration system to disengage from the refrigerated section and allow the movable tray to be moved relative to, or be removed from, the mobile refrigeration cabinet to provide easy access to the refrigeration system mounted thereon. In one embodiment, the vibration damping elements are manipulated by being compressed. The compression may occur as a result of a user interaction with an element, such as a handle, which causes the movable tray to compress the vibration damping elements. The handle may be engaged to an intermediary member, such as a cam, which operates on the movable tray to compress the vibration damping elements. In another embodiment, the vibration damping elements are manipulated by being moved vertically relative to the bottom surface of the non-refrigerated section on which they are mounted/secured. In another embodiment, the vibration damping elements are manipulated by translating the vibration damping elements with respect to each other.

The refrigeration system is also configured to be operated in a plurality of modes including, for example, a refrigeration mode and a battery powered mode, which may be selectable by a user or automatically activated. For example, when plugged into AC power, the user may select to run the refrigeration system in a refrigeration mode where refrigerated air is generated and blown into the refrigerated space. The user may also select to operate the mobile refrigeration cabinet in a battery powered mode where the refrigeration systems does not produce refrigerated air, but blows air into the refrigerated space to circulate the air contained therein. The mobile refrigeration cabinet may also be configured to sense the loss of AC power (such as when the system is unplugged for transport) and automatically enter a battery powered mode.

In one embodiment, a mobile refrigeration unit is provided that includes a refrigerated section, a non-refrigerated section, an opening between the refrigerated and non-refrigerated sections, a movable tray, a refrigeration system, and a biasing system. The non-refrigerated section includes an aperture in a side thereof for accessing the non-refrigerated section. The movable tray is disposed in the non-refrigerated section and is movable through the aperture. The refrigeration system is removably mounted on the movable tray. The biasing system engages the movable tray so as to bias the refrigeration system towards the opening between the refrigerated and non-refrigerated sections such that a portion of the refrigeration system sealingly engages the opening.

In another embodiment, a mobile refrigeration cabinet is provided with a refrigerated section, a non-refrigerated section that includes an aperture that provides access thereto, an opening between the refrigerated and non-refrigerated sections, a movable tray, a refrigeration unit, and a plurality of vibration damping elements. The movable tray is disposed in the non-refrigerated section and is movable in a substantially horizontal direction through the aperture. The refrigeration unit is removably mounted on the movable tray. The vibration damping elements support the movable tray relative to a base of the non-refrigerated section. The vibration damping elements reduce the transmission of vibrations from the base to the refrigeration unit removably mounted on the movable tray.

In yet another embodiment, a mobile refrigeration cabinet includes a refrigerated section, a non-refrigerated section, an opening between the refrigerated and non-refrigerated sections, a battery, a refrigeration system, and a control unit. The refrigeration system includes a fan configured to circulate air through the opening into the refrigerated section. The control unit is configured to control the refrigeration system to operate in a battery mode, in which the battery powers the fan which circulates unrefrigerated air in the refrigerated section, and a non-battery mode in which the refrigeration system receives electrical power from an external source and produces refrigerated air which is provided to the refrigerated section by the fan.

Further features and advantages of the present invention will become more apparent from the detailed description set forth below when taken in conjunction with the following drawings.

DRAWINGS

The features and advantages of the present invention will become more apparent from the detailed description set forth below when taken in conjunction with the following drawings.

DETAILED DESCRIPTION

Overview

The example embodiments of the invention presented herein are directed to mobile refrigeration cabinets. This is for convenience only, and is not intended to limit the application of the present invention. In fact, after reading the following description, it will be apparent to one skilled in the relevant art how to implement the following invention in alternative embodiments, involving, for example, mobile heated cabinets, mobile carts, storage containers, and refrigerators.

Figure 1:
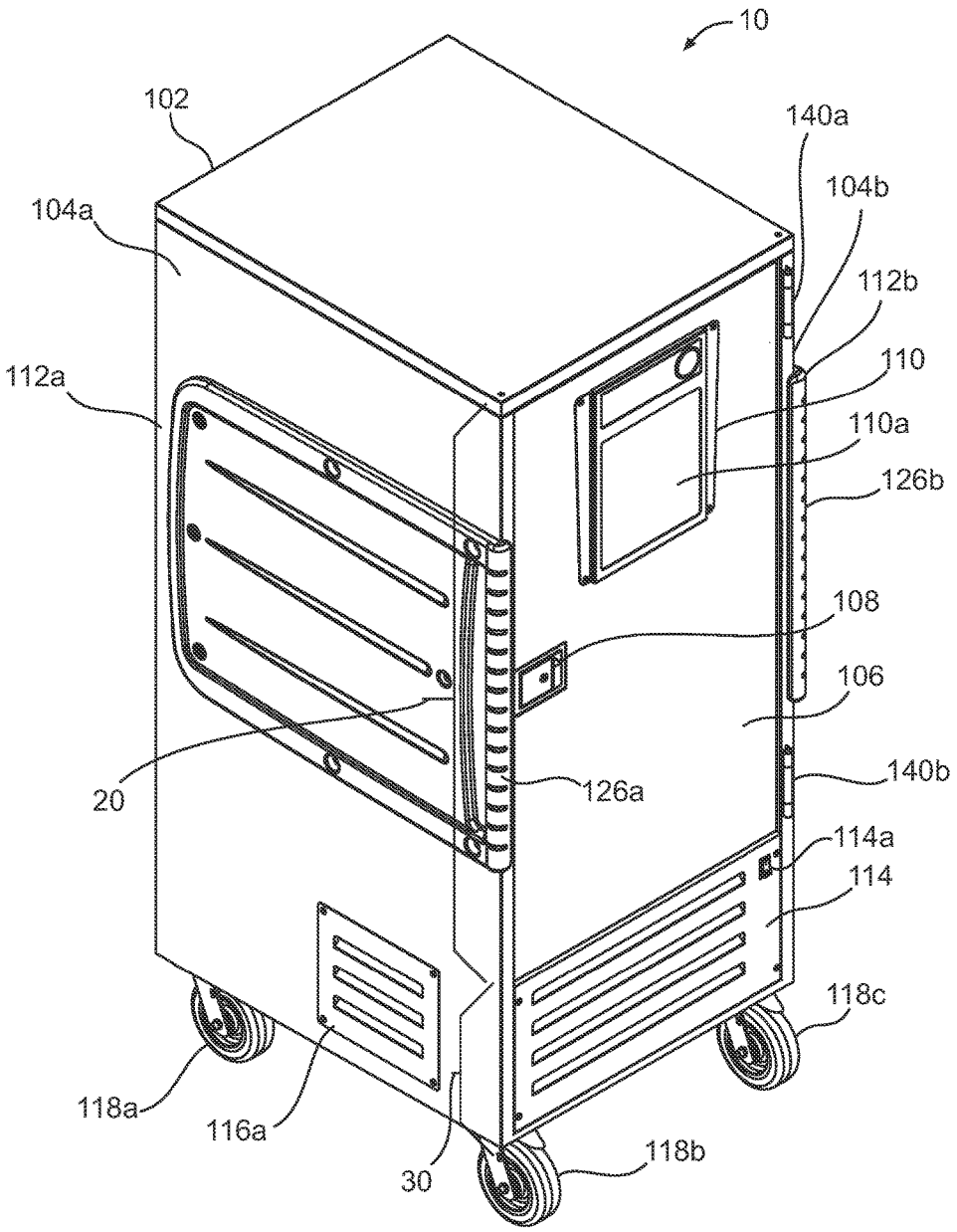
FIG. 1 is an external perspective view of a mobile refrigeration cabinet according to one embodiment.

FIG. 1 is a perspective view of a mobile refrigeration cabinet 10 according to one embodiment of the invention. The mobile refrigeration cabinet 10 includes a refrigerated space 20 located above a non-refrigerated space 30. Alternatively, the non-refrigerated space may be 30 located above the refrigerated space 20. The refrigerated space 20 is designed to store items, while the non-refrigerated space 30 is designed to accommodate the refrigeration system 300, shown in FIG. 7.

External Overview

Figure 2:
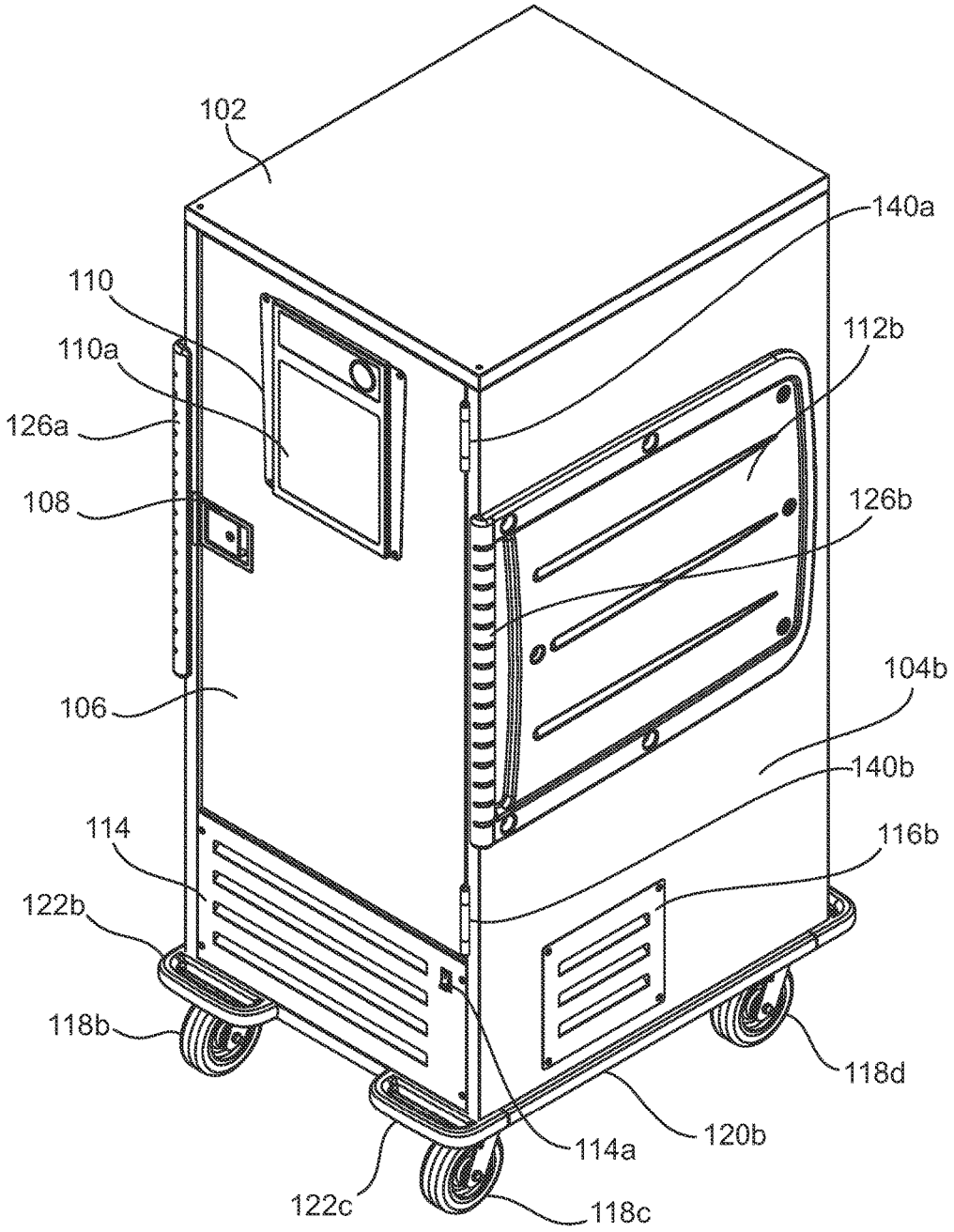
FIG. 2 is an external perspective view of a mobile refrigeration cabinet according to one embodiment.

FIGS. 1 and 2 are external views of an exemplary embodiment of a mobile refrigeration cabinet 10 according to the present invention. The mobile refrigeration cabinet 10 includes: an upper wall 102, two sides walls 104*a* and 104*b*, a rear wall 105 (shown in FIG. 4), a door 106 with a latch mechanism 108, an electrical connection port, a user interface 110, side bumpers 112*a* and 112*b*, a front ventilation panel 114, two side ventilation covers 116*a* and 116*b*, casters 118*a-d*, lower bumpers, lower handles, and an upper handle.

Figure 3:
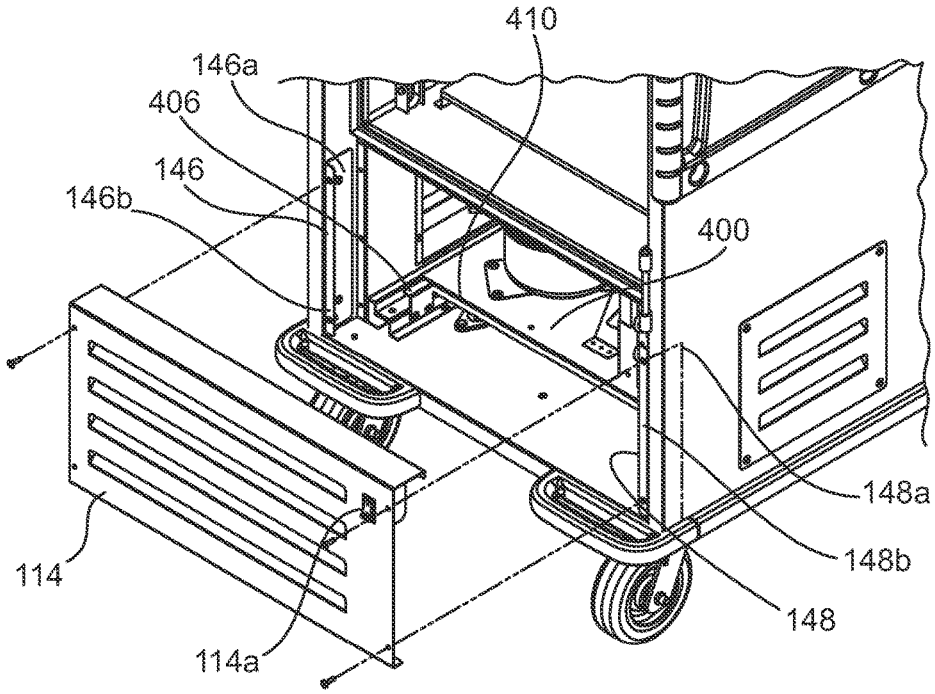
FIG. 3 is lower right perspective view showing the mounting of a ventilation panel to a mobile refrigeration cabinet according to one embodiment.

The side bumpers 112*a* and 112*b* are provided to dampen and otherwise protect the mobile refrigeration cabinet 10 from impacts with external objects, as well as protect the external object (e.g., walls and doors). As shown in FIGS. 1 and 2, the side bumpers 112*a* and 112*b* are provided on the left side wall 104*a* and the right side wall 104*b*, respectively. The particular location of the side bumpers 112*a* and 112*b* may be adjusted based on the overall height of the mobile refrigeration cabinet 10. For example, as shown in FIGS. 2 and 3, the side bumpers 112*a* and 112*b* may be provided over a range of about 40-75% of the height of the mobile refrigeration cabinet 10. This range is only exemplary, and depending upon the particular size of the mobile refrigeration cabinet 10, the side bumpers 112*a* and 112*b* may span the entire height and width of the side walls 104*a* and 104*b*, or any portion thereof.

The side bumpers 112*a* and 112*b* may also be configured to extend beyond the width of the side walls 104*a* and 104*b*. As shown in FIGS. 1 and 2, the side bumpers 112*a* and 112*b* include flange portions 126*a* and 126*b*, respectively. The flange portions 126*a* and 126*b* extend beyond the front end of the side walls 104*a* and 104*b* and wrap around the front corners of the mobile refrigeration cabinet 10. In the exemplary embodiment, the flange portions 126*a* and 126*b* are generally circular, so as to protect the mobile refrigeration cabinet 10, and the object it collides with, regardless of the angle of impact. The flange portions 126*a* and 126*b* may have the same vertical dimensions as the side bumpers 112*a* and 112*b*, or may extend beyond the vertical dimensions of the side bumpers 112*a* and 112*b*. In addition, the side bumpers 112*a* and 112*b* may include flange portions which extend beyond the rear end of the side walls 104*a* and 104*b* and wrap around the rear corners of the mobile refrigeration cabinet 10. In an alternative embodiment, the flange portions are separate physical structures from the side bumpers 112*a* and 112*b*, and may be provided in lieu of the side bumpers 112*a* and 112*b*. The side bumpers 112*a* and 112*b* and the flange portions 126*a* and 126*b* may be formed of any elastic material.

As shown in FIGS. 2 and 3, lower handles 122*b* and 122*c* may also be provided on the front of the mobile refrigeration cabinet 10. Lower handles may also, or alternatively, be provided on the rear of the mobile refrigeration cabinet as well.

The lower handles include an internal structural member made of a material which can be formed into the shape of a handle, including, for example, aluminum, aluminum alloys, steel, steel alloys, plastics, and carbon fiber alloys. The internal structural member of the lower handle is coated with a material which has an elastic property.

Each of the lower handles may be attached to the mobile refrigeration cabinet 10 by any number of fasteners including, for example, nuts and bolts, rivets, and screws.

As shown in FIG. 2, lower bumpers (e.g. 120*b*) may also be provided on the sides 104*a* and 104*b* of the mobile refrigeration cabinet to protect it. The lower bumpers may be fixed to the side walls 104*a* and 104*b* of the mobile refrigeration cabinet 10 by any number of fasteners including, for example, rivets and screws. Lower bumpers may also be provided on the rear wall 105 and the front ventilation panel 114 of the mobile refrigeration cabinet 10. The lower bumpers may also attach directly to the side walls 104*a* and 104*b* without engaging the lower handles.

The door 106 is constructed from two pieces of sheet metal joined together around a skeletal structure which creates a door cavity. The door cavity is filled with an insulating material. In one embodiment, the insulator is a polyurethane foam which is a poor conductor of heat. The polyurethane foam may be injected into the door cavity, resulting in a relatively homogenous distribution. One advantage of polyurethane foam, as compared to fiberglass insulation, is that the foam is sprayed into the door cavity and then rapidly expands to fill the cavity. The foam effectively blocks air migration through the door cavity. As a result, minimal, if any, heat transfer via convection through the door 106 itself occurs. When the polyurethane foam cures and hardens, it provides significant torsional rigidity and strength to the door 106. As a result, the door 106 skeletal structure is less extensive than conventional mobile refrigeration cabinets, resulting in an overall reduction in weight.

In a similar manner, the side walls 104*a* and 104*b*, the rear wall 105, the upper wall 102, and an interior bottom wall 202 of the refrigerated space 20, are also formed from two pieces of sheet metal joined together around a respective skeletal structures to form respective cavities. These cavities may also be injected with polyurethane foam. As discussed above, the cured polyurethane foam adds additional torsional rigidity and strength. Accordingly, the respective skeletal structures are less extensive than in conventional mobile refrigeration cabinets. Alternative materials may be also used to construct the mobile refrigeration cabinet 10 instead of sheet metal such as, for example, carbon fiber, plastics, and fiber resins composites.

Figure 4:
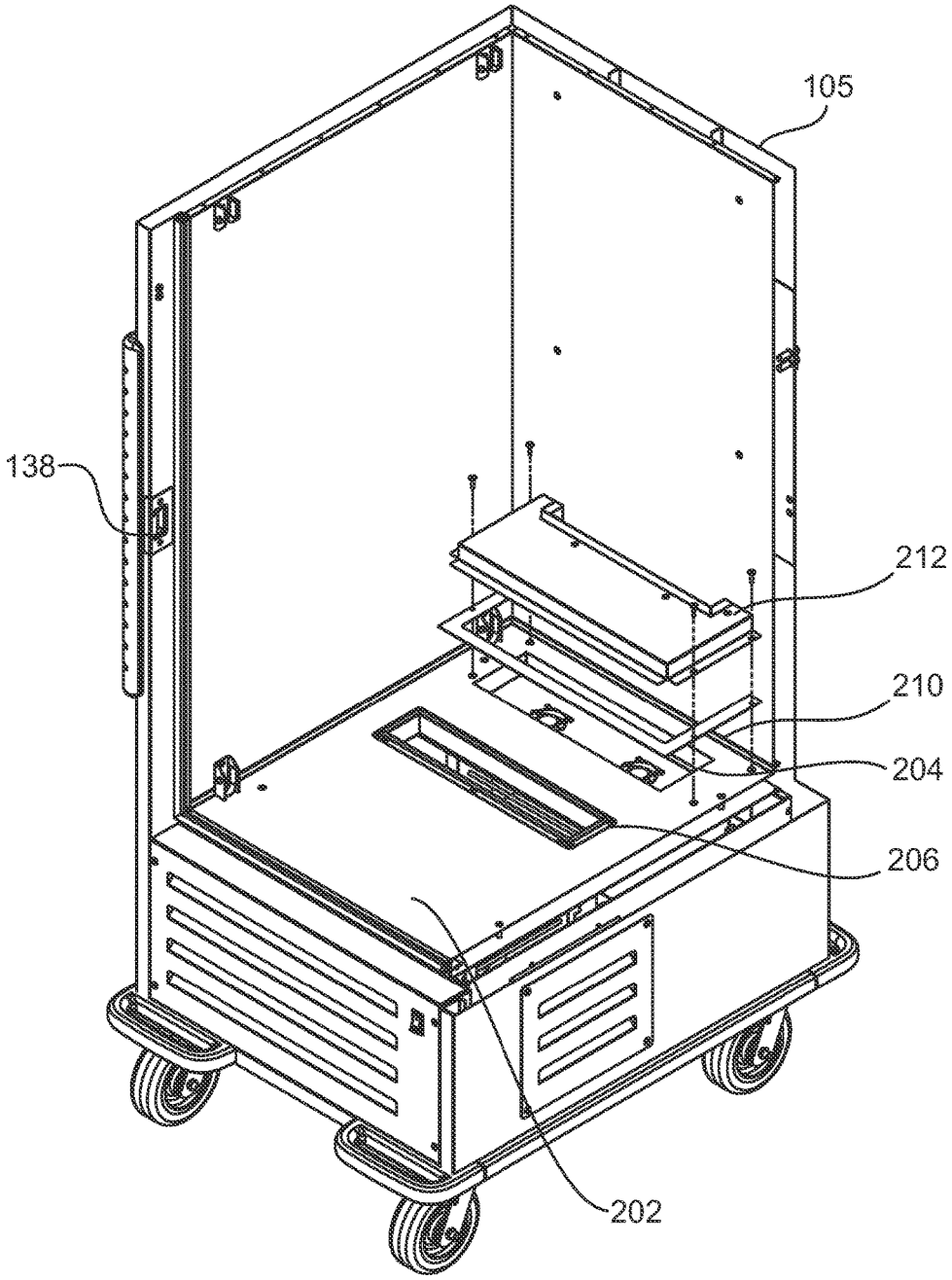
FIG. 4 is a cut-away external perspective view of a mobile refrigeration cabinet according to one embodiment.

As shown in FIGS. 1, 2 and 4, the door 106 preferably includes a latch mechanism 108 comprising a striker which engages a corresponding receptacle 138 formed in the side wall 104*a*. Preferably, at least two hinges 140*a* and 140*b* are provided to secure the door 106 to the side wall 104*b*. Depending upon the size of the mobile refrigeration cabinet 10, three or more hinges may be provided. Furthermore, the flange portions of the side bumpers 112*a* and 112*b* may include indentations to allow for the hinges 140*a* and 140*b*.

The door 106 engages a door flange disposed within the refrigerated space 20 at such a position as to allow the door 106 to be flush with edges of the side walls 104*a* and 104*b* when the door 106 is closed. A door gasket is attached to the side of the door flange which faces the door 106. The door gasket is compressed when the door is closed and maintained in a compressed state by the engagement of the striker with the receptacle 138. This arrangement provides an effective barrier between the refrigerated space 20 and the external environment, thus mitigating, if not preventing, air migration around the periphery of the door 106 when the door 106 is closed.

As shown in FIGS. 1 and 2, the door 106 also includes a user interface 110 which, in the preferred embodiment, is secured to the upper half of the door 106. The user interface 110 includes a writable surface area 110*a*, preferably a dry erase surface, on which a user can display relevant messages, such as the contents of the mobile refrigeration cabinet 10.

The side walls 104*a* and 104*b* also may include side ventilation grills 116*a* and 116*b*, respectively, which allow air to flow in and out of the non-refrigerated space 30. The ventilation grills 116*a* and 116*b* are attached to the side walls 104*a* and 104*b*, respectively, by fasteners such as, for example, screws and rivets.

The front portion of the non-refrigerated space 30 is covered by a front ventilation panel 114. The front ventilation panel 114 also includes a power control switch 114*a* which connects to the refrigeration system 300 contained within the non-refrigerated space 30. The power control switch 114*a* allows the user selectively power the refrigeration system 300 on and off. The front ventilation panel 114 preferably has an L-shaped cross section that includes an upper flange portion and a lower flange portion. The upper flange portion extends into the non-refrigerated space 30 to a greater depth than the lower flange portion. In addition, the distal end of the upper flange portion is bent so as to be substantially vertical.

As shown in FIG. 3, the front ventilation panel 114 is preferably attached to two interior mounting brackets 146 and 148 which are attached to the interior portions of the side walls 104*a* and 104*b*, respectively. Each of the interior mounting brackets 146 and 148 has an L-shaped cross section so as to provide two mounting surfaces 146*a* and 146*b*, as well as 148*a* and 148*b*, respectively. The first mounting surfaces 146*a* and 148*a* allow the interior mounting brackets 146 and 148 to connect to the side walls 104*a* and 104*b*, respectively. The second mounting surfaces 146*b* and 148*b* allow the front ventilation panel 114 to be securely attached to the mobile refrigeration cabinet 10. The front ventilation panel 114 may be secured to mobile refrigeration cabinet 10 by numerous types of fasteners including screws and rivets. In a preferred embodiment, the fasteners are hand screws that include an enlarged head which can be manipulated without a tool.

As shown in FIGS. 1 and 2, the exemplary mobile refrigeration cabinet 10 includes a plurality of casters 118*a*, 118*b*, 118*c*, and 118*d* attached to the bottom wall 150 of the cabinet (e.g., bottom of non-refrigerated space). The plurality of casters 118*a*, 118*b*, 118*c*, and 118*d* allow the mobile refrigeration cabinet 10 to move in any direction. While the plurality of casters 118*a*, 118*b*, 118*c*, and 118*d* may be directly attached to the bottom wall of the non-refrigerated space 150, the plurality of casters 118*a*, 118*b*, 118*c*, and 118*d* may also be attached to caster mounting brackets which in turn are connected to the bottom wall of the non-refrigerated space 150 and the side walls 104*a* and 104*b*. The caster mounting brackets may be connected to the bottom wall of the non-refrigerated space 150 and the side walls 104*a* and 104*b* by any number of fasteners including, for example, rivets, nuts and bolts, and screws. The caster mounting brackets also provide additional mounting surfaces for connecting the lower handles to the mobile refrigeration cabinet 10.

Refrigerated Space

The refrigerated space may include a plurality of mounting brackets which extend vertically within the refrigerated space along the interior portions of the side walls 104*a* and 104*b*. At least two mounting brackets may be provided along the interior portion of each side wall 104*a* and 104*b*, with one of the mounting brackets being located towards the front of the refrigerated space, near the door 106, and the other mounting bracket being located towards the rear of the refrigerated space 20. In one embodiment, the mounting brackets located near the door 106 lie substantially within the same plane. Similarly, the mounting brackets located near the rear of the refrigerated space also lie substantially within the same plane.

Each of mounting brackets includes a slot which is configurable to receive a platform support element, which is adjustable in the vertical direction over the height of the mounting bracket. The platform support element includes a support portion configured to engage a shelf. A plurality of platform support elements may be provided for each mounting bracket and engaged thereto. In addition, a group of platform support elements disposed in respective mounting brackets may be arranged to lie substantially in the same horizontal plane, so as to support a shelf which rests upon the group of platform support elements.

As also shown in FIG. 4, the bottom wall 202 of the refrigerated space 20 includes a refrigerated air intake opening 204 and a return air opening 206.

Figure 5:
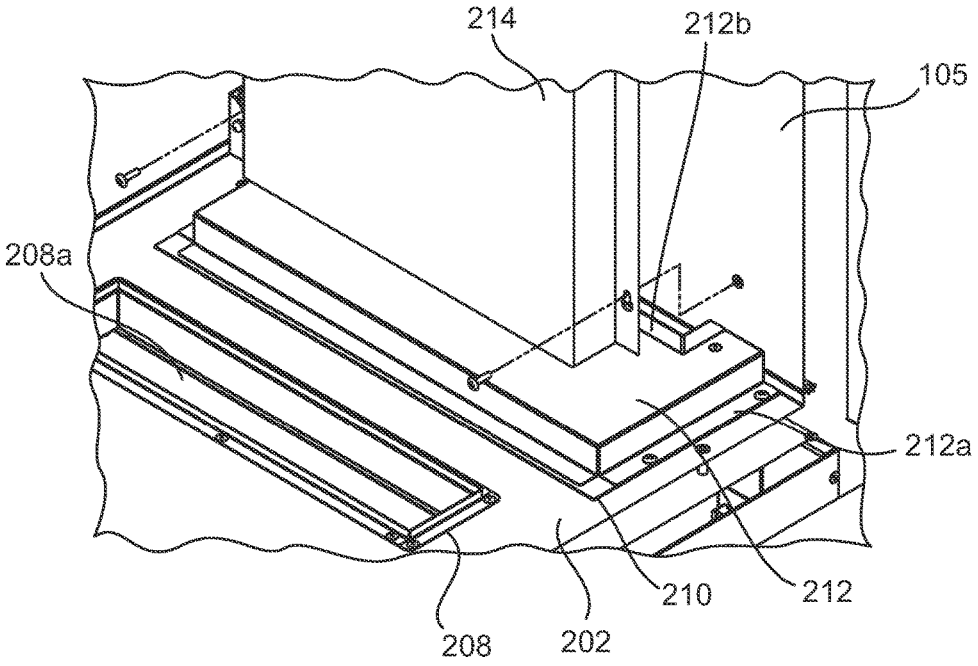
FIG. 5 is a view showing a duct connected to a mobile refrigeration cabinet according to one embodiment.

To ensure that any water, which may be produced by condensation of humid air introduced into the refrigerated space 20, does not leak into the non-refrigerated space 30 where the refrigeration system is stored, a water dam 208 is provided around the periphery of the return air opening 206, as shown in FIG. 5. The water dam 208 is a rectangular frame structure with an opening 208*a* provided in the center. The dimensions of the opening 208*a* correspond to the dimensions of the return air opening 206. The water dam 208 is attached to the bottom wall 202 of the refrigerated space 20 by a plurality of fasteners, such as, rivets, screws, and nuts and bolts. To ensure water does penetrate the underside of the water dam 208, a gasket or sealant (such as silicone) may be disposed underneath the water dam 208 and compressed between the water dam 208 and the bottom wall 202 by the force of the fasteners, to ensure a watertight seal. The water dam 208 has a generally L-shaped cross-section, so as to create a vertical obstruction to the movement of any water on the surface of the bottom wall 202.

Figure 7:
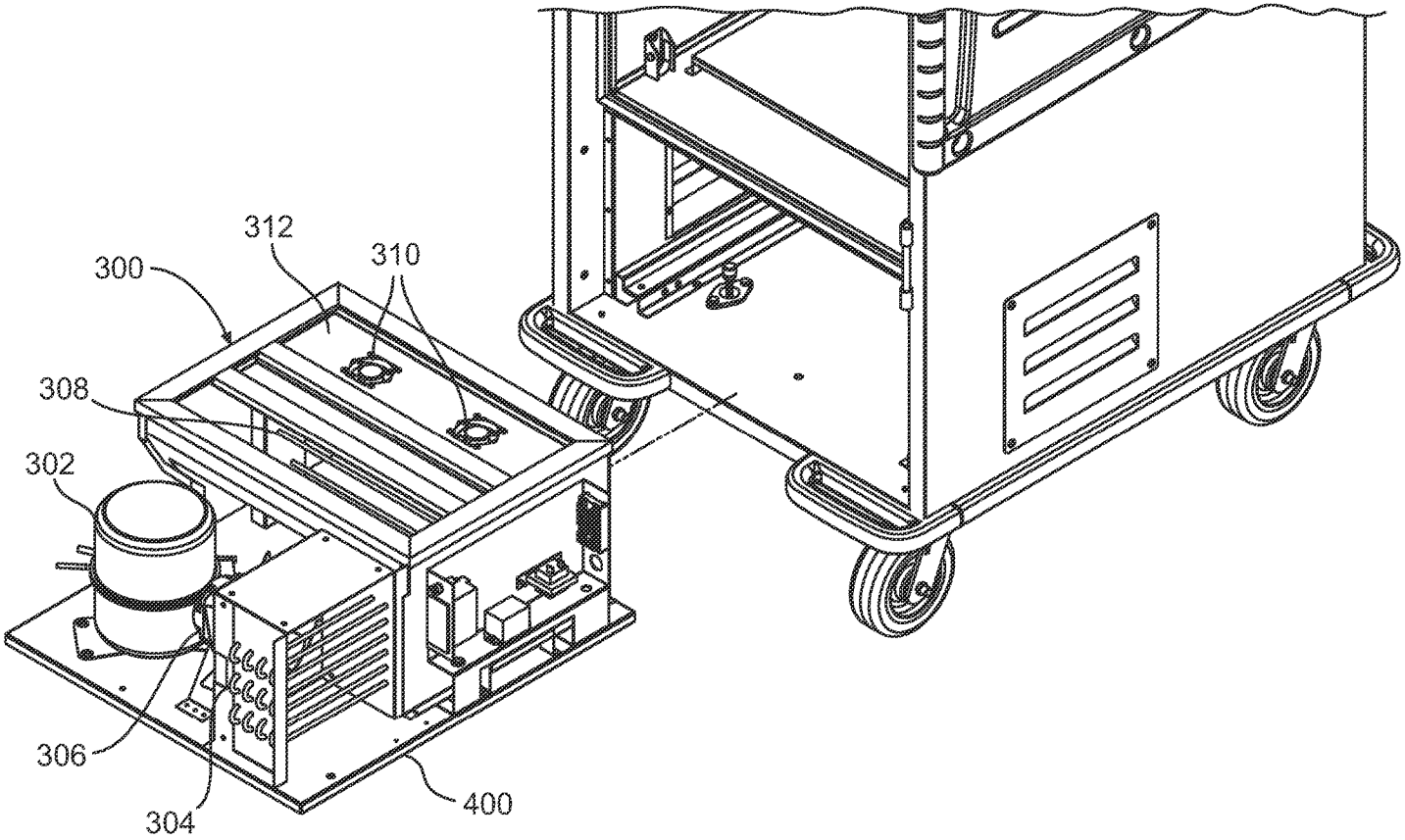
FIG. 7 is an external perspective view showing the engagement of the refrigeration system to the non-refrigerated space of a mobile refrigeration cabinet according to one embodiment.

The refrigerated air intake opening 204 allows the refrigeration system 300 to supply the refrigerated space 20 with refrigerated air. In the exemplary embodiment, the refrigerated air intake opening 204 is rectangular, however, other shapes may be used to match an exhaust port 312 from the refrigeration system 300, as shown in FIG. 7.

As shown in FIG. 5, to ensure that water does not enter the non-refrigerated space via the refrigerated air intake opening 204, a gasket 210 may be provided. In the exemplary embodiment, the gasket 210 does not directly correspond to the dimensions of the refrigerated air intake opening 204, but rather the dimensions of a lower flange portion 212*a* of an exhaust deflector 212 which connects to the bottom wall 202 so as to compress the gasket 210 creating a watertight seal. The exhaust deflector 212 may be attached to the bottom wall 202 by any number of fasteners including, for example, screws, rivets, and nuts and bolts.

As shown in FIG. 5, the exhaust deflector 212 includes an upper flange portion 212*b* which is configured to contact the underside of a duct 214 which runs from the top of the exhaust deflector 212 to near the top of the refrigerated space 20. The duct 214 is attached to the interior portion of the rear wall 105 by fasteners such as, for example, rivets, screws, and nuts and bolts. The duct 214 is designed to carry refrigerated air which enters the refrigerated space 20 from the refrigerated air intake opening 204 to the near the top of the refrigerated spaced 20.

Figure 6:
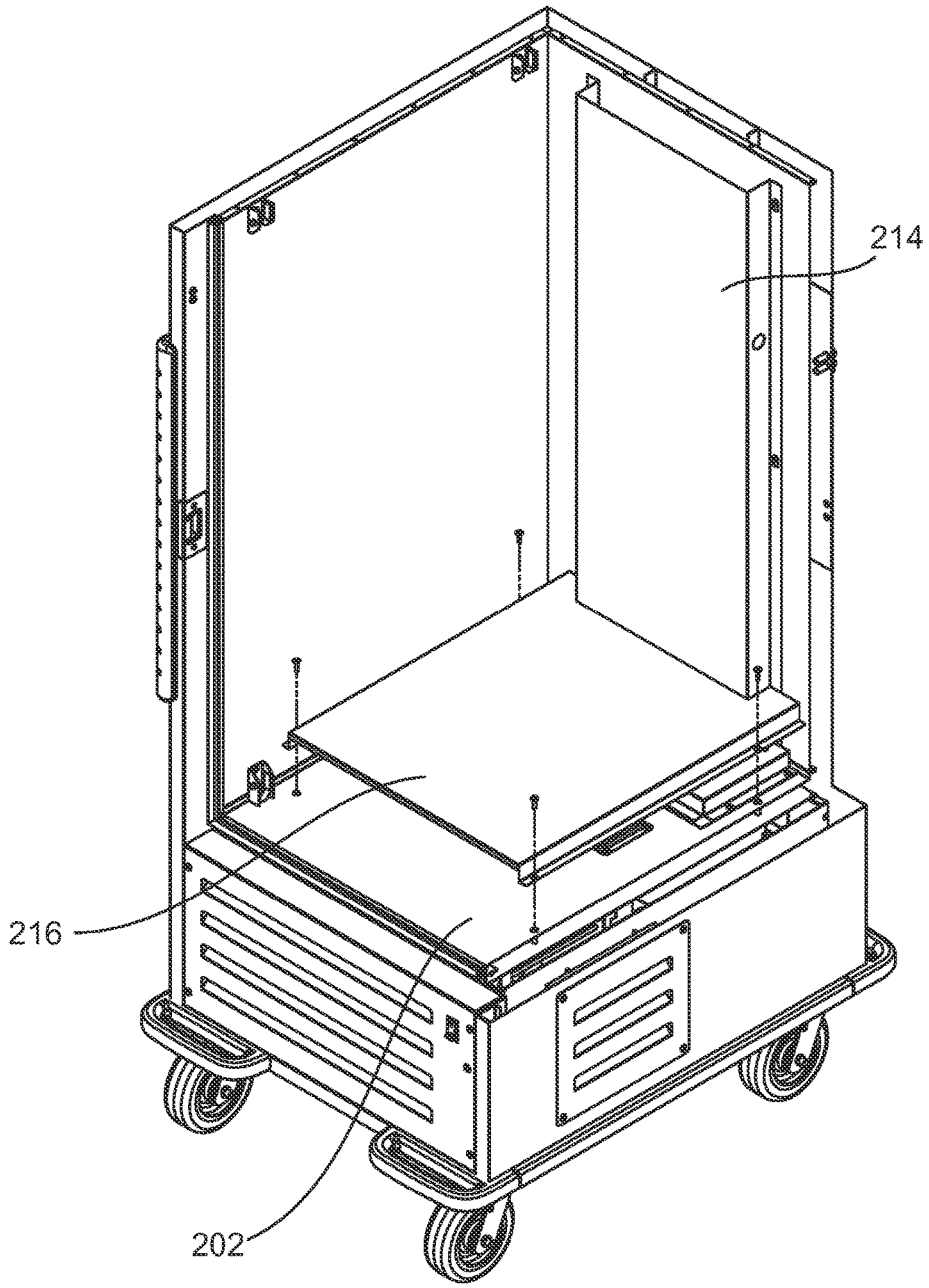
FIG. 6 is a cut-away external perspective view of the refrigerated space of a mobile refrigeration cabinet according to one embodiment.

As shown in FIG. 6, an intake cover 216 is disposed above the water dam 208 and the exhaust deflector 212. The intake cover 216 includes a notched portion which accommodates the duct 214 running vertically. The intake cover 216 is designed to ensure that items or spills do not enter the non-refrigerated space 30 below. Accordingly, the intake cover 216 spans nearly the entire width of the bottom wall 202 and is secured thereto by fasteners.

Non-Refrigerated Space

The non-refrigerated space 30 is designed to accommodate the refrigeration system 300.

The Refrigeration System

As one of ordinary skill in the art will appreciate, the refrigeration system 300 includes a compressor 302, a condenser 304, a condenser fan 306, a throttle valve, an evaporator 308, an evaporator fan 310, an air outlet 312, a gasket, an AC power connection, a battery 318, and a control unit 320.

When plugged into an AC power source, the refrigeration system 300 cools the refrigerated space 20 according to the well known refrigeration cycle. More specifically, the compressor 302 causes the refrigerant to enter a superheated gaseous state, at which point the superheated refrigerant passes through the condenser 304 and gives off heat which is expelled through the front and side ventilation panels 114, 116*a*, and 116*b* by the condenser fan 306, as the refrigerant transitions to a liquid. The refrigerant enters a throttle valve whereby the refrigerant expands and rapidly cools causing a phase transformation to a liquid-gaseous state. The refrigerant absorbs heat from the refrigerated space 20 which results in the further transition of the refrigerant into a gaseous state as the refrigerant passes through the evaporator coils. The evaporator fan 310 blows air over the evaporator coils and into an air outlet 312. When housed in the non-refrigerated space 30, the air outlet directs the refrigerated air into the refrigerated air intake opening 204 and on into the duct 214 to thereby cool the refrigerated space 20. The refrigerant returns to the compressor 302 whereby the cycle is repeated.

In the exemplary embodiment the refrigeration system 300 is removably mounted to an exemplary movable tray 400, as shown in FIG. 7. The movable tray 400 may be wholly or partly removable so as to provide access to the refrigeration system 300. Specifically, the movable tray 400 may be slidably disposed so as to be movable in a horizontal manner in the direction of the front ventilation panel 114.

The movable tray 400 is dimensioned to fit in a space whose width is defined by two mounting brackets, e.g. 402. It is noted that the other mounting bracket is substantially identical and disposed on the opposite side of the refrigerated space. The mounting brackets are respectively positioned against the interior of the side walls 104*a* and 104*b* of the non-refrigerated space 30, and connected to the bottom wall 150 of the non-refrigerated space 30, as shown in FIG. 8.

In an alternate embodiment, the movable tray 400 may rest on or be connected to a sliding mechanism which allows the movable tray 400 to be translated to an external position, where the refrigeration system 300 can be repaired or removed.

The mounting brackets are characterized by a step profile. As shown in FIG. 8, the mounting bracket 402 includes a middle step 402*a* which has a tread 402*b* with a reduced friction surface to allow the bottom of the movable tray 400 to slide thereon. The tread 402*b* of the middle step 402*a* may be a material with a low coefficient of friction, or a substrate which is coated by a material with a low coefficient of friction. Mounting bracket 404 has a substantially similar structure. Accordingly, a detailed description of mounting bracket 404 is presently omitted.

Figure 8:
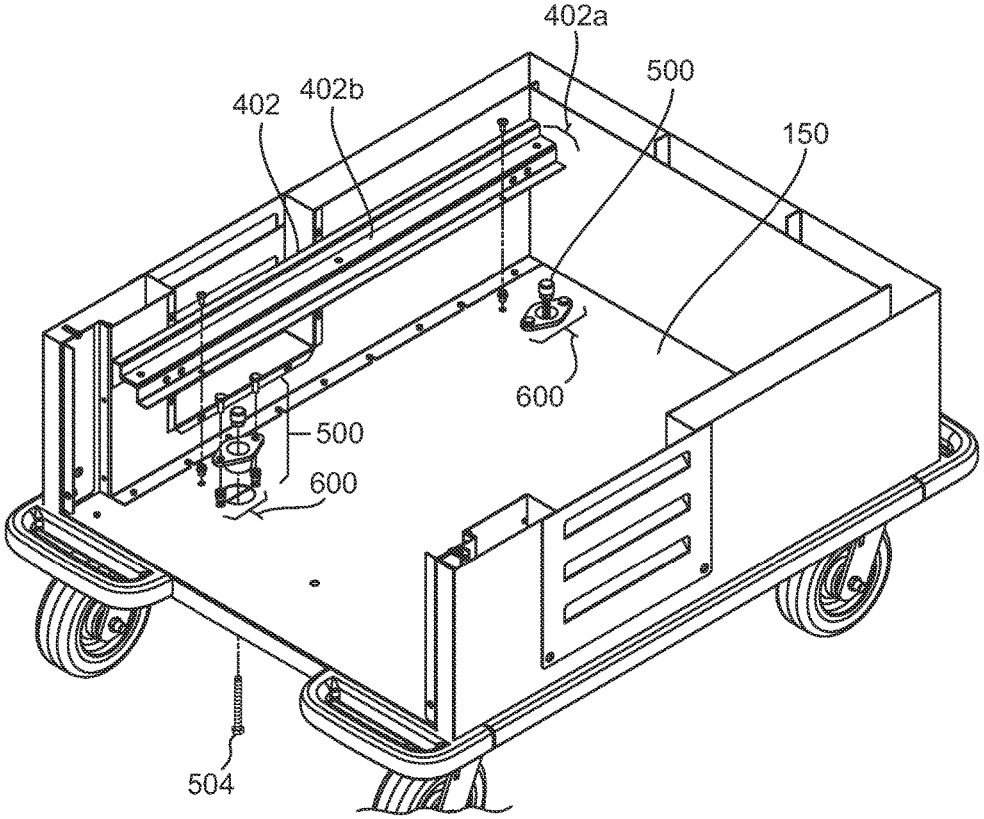
FIG. 8 is an external perspective view of the non-refrigerated space of a mobile refrigeration cabinet according to one embodiment.
Figure 9:
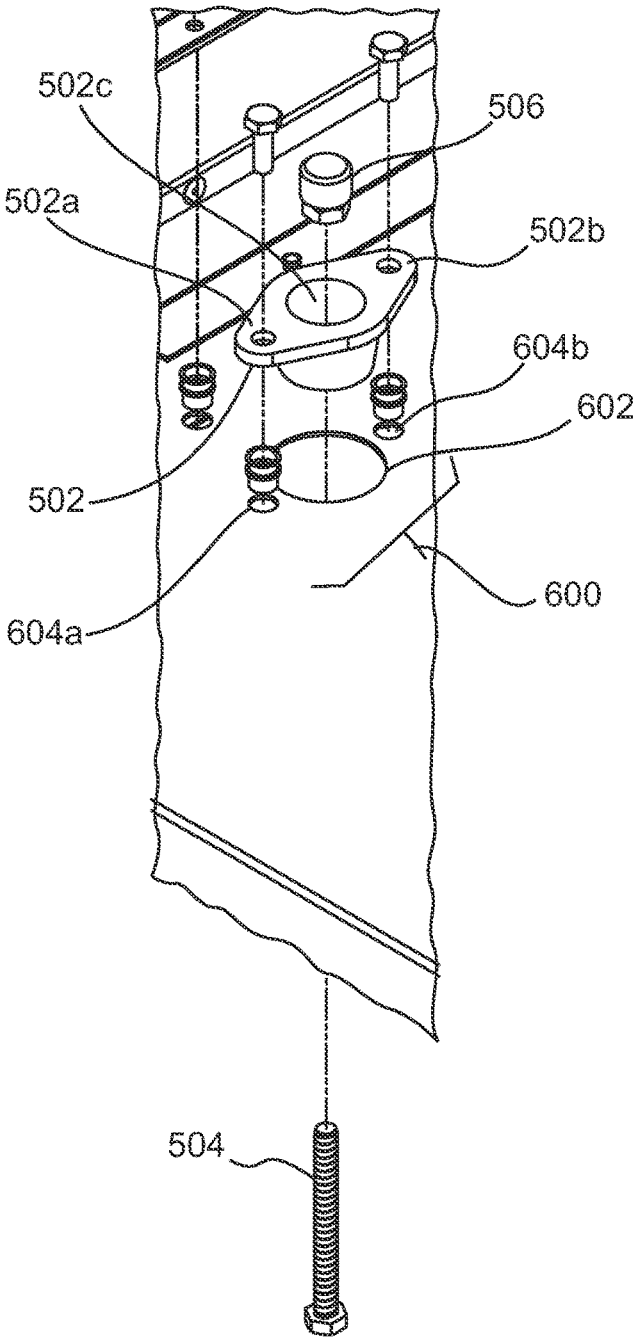
FIG. 9 is a view of a vibration damping isolator for a mobile refrigeration cabinet according to one embodiment.

FIGS. 8 and 9 also show a biasing system with a plurality of biasing mechanisms, such as a plurality of vibration damping isolators 500, which may be disposed in corresponding mounting areas 600 located on the bottom wall 150 of the non-refrigerated space. The vibration damping isolators 500 are mounted to the mobile refrigeration cabinet 10 so as to bias the movable tray 400 so that its weight is supported by the vibration damping isolators 500, thereby isolating the refrigeration system 300 from the forces experienced by the mobile refrigeration cabinet 10.

While an exemplary vibration damping isolator 500 is shown and discussed below, the present invention is not limited to such a configuration. The vibration damping isolators may be any device which deforms in response to an applied force, so as to absorb vibrations from bumps transferred through the cabinet 10, e.g., from the casters, or impacts from collisions with external objects, and which provides a dampening capability relative to the cabinet. This avoids problems associated with caster mounted damping devices that result in instability of the cabinet relative to the cabinet.

FIG. 8 shows two vibration damping isolators 500 arranged near the side wall 104*a*. In a preferred embodiment two or more vibration damping isolators 500 are provided near the side wall 104*b*. Alternatively, three or more vibration damping isolators 500 may be used, as such a configuration with provide support for the plane defined by the three vibration damping isolators 500. Each of the vibration damping isolators 500 and the mountings areas 600 are identical, except for their positions on the bottom wall 150 of the non-refrigerated space. An exemplary description of a vibration damping isolator 500 and a mounting area 600 is provided below. In a simple configuration, however, a preferred design includes a dampening component, which may be an elastomeric material, spring or the like, and a mounting component for securing the dampening component to the cabinet.

As shown in FIG. 9, the mounting area 600 includes a bolt-down vibration damping mount hole 602 and two fastening holes 604*a* and 604*b* formed in the bottom wall 150 of the non-refrigerated space 30. The vibration damping isolator includes: a bolt-down vibration damping mount 502, a threaded bolt 504, and a swivel pad 506.

The bolt-down vibration-damping mount 502 includes a plurality of connecting holes 502*a* and 502*b* for receiving fasteners to secure the bolt-down vibration-damping mount 502 to the bottom wall 150 of the non-refrigerated space 30. The bolt-down vibration-damping mount 502 also includes a threaded rubber portion 502*c*, configured to receive the threaded bolt 504, disposed in the vertical direction 502*c*. The bolt-down vibration-damping mount 502 is composed of an elastomeric material, which is deformed when a force is applied thereto. The elasticity of the bolt-down vibration-damping mount may be varied according to the amount of deflection desired. One factor which affects the choice of elastomeric material is the type of gasket used to connect the refrigeration system 300 to the refrigerated space 20. If a deformable gasket is used, which is capable of maintaining seal over a large distance between the items it connects, then a more elastic material may be used in for the bolt-down vibration-damping mount 502. An advantage of a more elastic material, is that it is capable of dissipating more energy.

As shown in FIG. 9, the bolt-down vibration-damping mount 502 is inserted into the bolt-down vibration damping mount hole 602 so as to protrude through the bottom wall 150 of the non-refrigerated space 30 to the exterior of the mobile refrigeration cabinet 10. The bolt-down vibration-damping mount 502 is arranged so that the two connecting holes 502*a* and 502*b* align with the two fastening holes 604*a* and 604*b* in the mounting area 600. Fasteners are used to secure the bolt-down vibration damping mount 502 to the bottom wall 150 of the non-refrigerated space 30.

The swivel pad 506 includes a ball portion and a socket portion, and is able tilt over a range of approximately 0-10.degree. The range is merely exemplary, and a range from 0-180.degree. is contemplated. One of the advantages of the swivel pad 506, is that it can tilt to remain flush against the bottom of the movable tray 400. This is because the mobile refrigeration cabinet 10 may experience applied forces from any direction. The movable tray 400 may therefore be displaced in any direction in response to the applied force. Since, in this embodiment, the applied force is transferred to the bolt-down vibration-damping mount 502 via the connection between the movable tray 400 and the swivel pad 506, it is preferable that a flush connection between the two is maintained.

Alternatively, a spherical structure may be provided which replaces the swivel pad 506. Regardless of the direction the applied force, the spherical structure would allow the threaded bolt 504 to translate in response to movement of the movable tray 400, while maintaining contact with the bottom surface of the movable tray 400.

The height of the swivel pad 506 relative to the bottom wall 150 of the non-refrigerated space 30 can thereby be adjusted by turning the threaded bolt 504 clockwise or counterclockwise. In the exemplary embodiment, the height of the swivel pads 506 in each of the vibration damping isolators 500 are adjusted to bias the bottom of the movable tray 400 towards the bottom wall 202 of the refrigerated space 20 with a predetermined amount of force. The force applied by the vibration damping isolators 500 to the movable tray 400, lifts the refrigeration tray 400 so that the air outlet 312 compresses a gasket provided between the air outlet 312 and the portion of the top wall of non-refrigerated space 30 surrounding the refrigerated air intake opening 204. The compression of the gasket ensures that refrigerated air emitted by the refrigeration system 300 is directed into the duct 214.

If a user wishes to remove the movable tray 400 from the non-refrigerated space, the threaded bolts 504 can easily be retracted from the bottom surface of the movable tray 400, by unscrewing the threaded bolts 504. As the threaded bolts 504 are retracted, the movable tray 400 is lowered relative to the top wall of the non-refrigerated space. This causes the air outlet 312 to disengage from the portion of the top wall of the non-refrigerated space 30 surrounding the refrigerated air intake opening 204. As the threaded bolts 504 are continued to be retracted, the movable tray 400 comes to rest to on the treads of the middle steps of the mounting brackets. As described above, the mounting brackets allow the movable tray 400 to be slid in and out of the non-refrigerated space 30. While in preferred embodiments the movable tray 400 is completely removed, as discussed above one or more stop mechanisms may be provided which allow the movable tray 400 to move only a predetermined distance horizontally (towards the front ventilation panel 114). Regardless of whether the movable tray 400 is completely removed or partially removed from the non-refrigerated space 30, it is preferable to provide a locking mechanism that prevents unintentional movement of the movable tray 400 along the mounting brackets, or a track, during normal use. Such locking mechanisms preferably do not inhibit movement of the movable tray 400 in a vertical direction.

An example locking mechanism is shown in FIG. 3. A stop flange 406 is provided adjacent to the front edge 410 of the movable tray 400. A substantially identical flange may also be provided on the opposite side as well. Preferably, the stop flanges are positioned to prevent movement in the direction in which the movable tray 400 is withdrawn from the non-refrigerated space 30 (i.e., in the direction of the front ventilation panel 114). The stop flanges may be removable flanges, latches, screws, bolts, and other known mechanisms.

In the exemplary embodiment, the stop flanges are disposed near or at opposite ends of the movable tray 400 in the horizontal direction, and are substantially similar. The stop flange 406 may include openings through which a fastener connects the stop flange 406 to the mounting bracket 402, thereby preventing the movable tray 400 from moving towards the front and/or rear of the mobile refrigeration cabinet.

The height of each of the stop flanges is preferably selected based upon the degree of biasing by the vibration damping isolators 500. As discussed above, the vibration damping isolators 500 bias the movable tray towards the bottom wall 202 of the refrigerated space 20. Thus, when biased, the movable tray 400 is displaced in the vertical direction proportionately to the magnitude of the biasing force. The stop flanges are preferably dimensioned to account for the displacement of the movable tray 400 when biased. More preferably, the height of each stop flange (or section configured to engage the movable tray 400) is equal to or greater than the range of vertical displacement of the movable tray 400.

Another advantage of the exemplary embodiment, is that a user may quickly gain access to entire refrigeration system 300. Therefore, if the refrigeration system 300 should fail, a user or service person can quickly access the refrigeration system 300, by partially or fully removing the movable tray 400. If necessary, the refrigeration system 300 can be replaced.

To remove the refrigeration system 300 in the exemplary embodiment, a power cord, fed through the electrical connection port in the rear wall 105, is disconnected from the AC power connection. The front ventilation panel 114 may be removed by, in the preferred embodiment, manipulating the hand screws used to secure it to the mobile refrigeration cabinet 10. Other types of fastener which may preferably be manipulated without the need for a tool, may be used for items (e.g., the front ventilation panel 114 and the stop flanges) which require their fasteners to be manipulated to remove the movable tray 400.

The stop flanges may be removed by disconnecting them from their respective mounting brackets. The vibration damping isolators 500 may be retracted from the movable tray 400 by turning the threaded bolts 504, which simultaneously reduces/eliminates the biasing force. As a result, the refrigeration system 300 disengages from the refrigerated air intake opening 210, allowing the movable tray 400 (on which the refrigeration system 300 is mounted) to be removed by sliding it along the mounting brackets.

As discussed above, the vibration damping isolators are not limited to the above described embodiment. Alternatively, the vibration damping isolators may be a plurality of springs. The plurality of springs may be attached to the bottom wall of the non-refrigerated and engage either directly the movable tray 400 or an intermediary piece, to bias the movable tray towards the refrigerated space 20.

The springs may be mounted in the same positions as the vibration damping isolators shown in FIG. 9 or in a different position. The springs may also include pads (or other mounting mechanisms) to engage the bottom of the movable tray 400, to ensure flush connection there between. The spring constant may also be adjusted to ensure the movable tray 400 is sufficiently biased to compress the gasket 314 and create a seal.

A compression mechanism may also be provided to overcome the biasing force applied by the springs, which allows the movable tray 400 to be removed. The compression mechanism can be any mechanism which compresses the springs. The compression mechanism allows the movable tray 400 to move from an engaged position, closer to the refrigerated section 20, to a disengaged position.

For instance, a cam and a handle mechanism may be provided to compress the springs and allow the refrigeration system to disengage from the refrigerated air intake opening 204. The cam and handle may be unibodily formed or formed from a plurality of parts. The rotation of the handle causes the net force acting on the movable tray 400 to be in the opposite direction from the biasing force, thereby lowering the movable tray 400. In yet another alternative, a plurality of cams may be operated by the rotation of the handle to compress the plurality of springs.

While a single handle may be employed to operate one or more cams, a second handle may also be provided to operate the cams or a separate cam connected directly to the movable tray or via a structural connector. In such an embodiment, an additional access panel may be provided on the mobile refrigeration cart to access the second handle, if necessary. The second handle and the corresponding access panel may be located anywhere on the mobile refrigeration cart.

The springs may include the swivel pad 506 discussed above to maintain a flush contact between the movable tray 400 and the springs. As discussed above, however, alternate mechanisms may be provided to maintain a flush connection such a ball joint.

Figure 10:
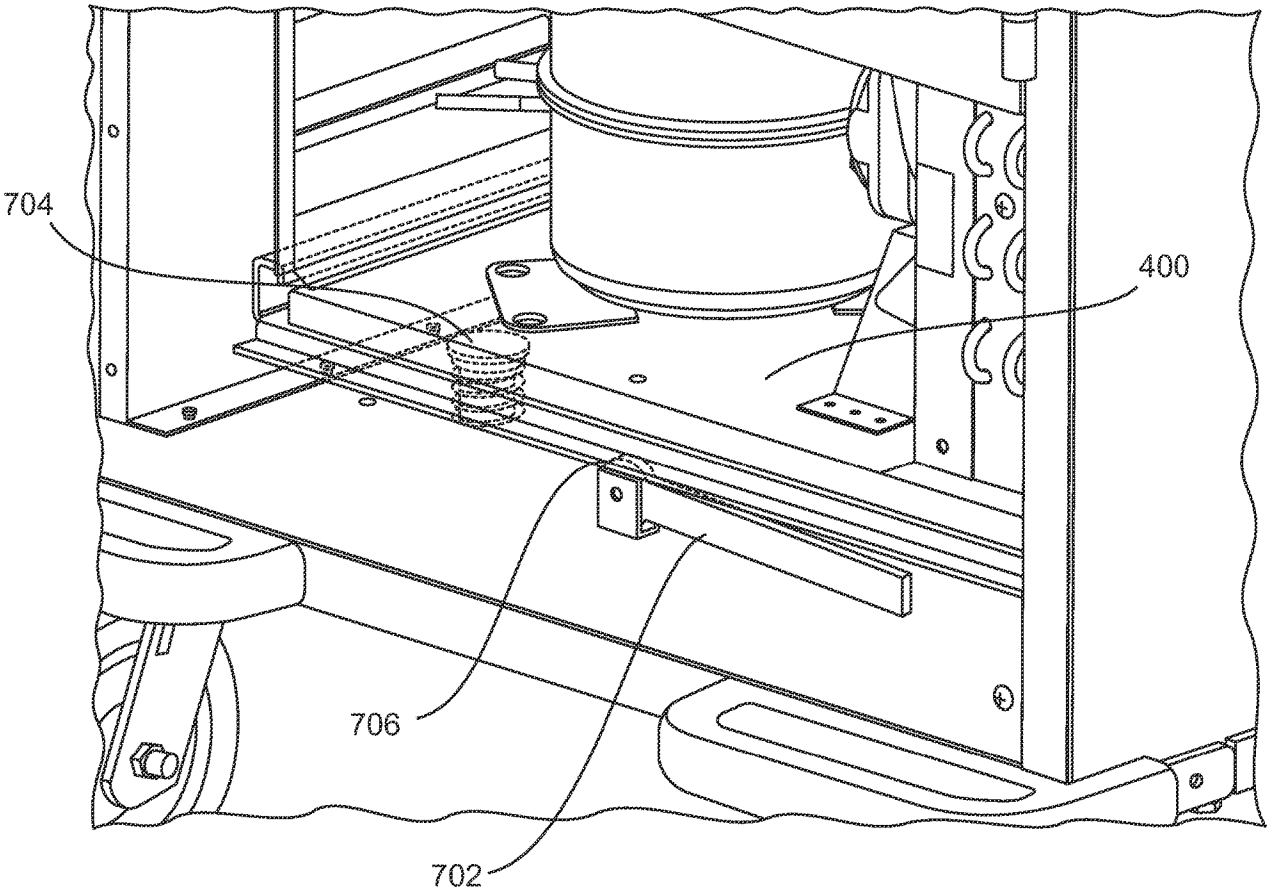
FIG. 10 is an external perspective view showing a handle and a cam for a mobile refrigeration cabinet according to one embodiment.

FIG. 10 illustrates an alternate embodiment in which a handle 702 is directly attached to a cam 706. When the handle 702 is rotated the cam 706 acts on an intermediary piece connected to the movable tray 400. The biasing action of the cam 706 on the tray causes the springs 704 to compress.

Figure 11:
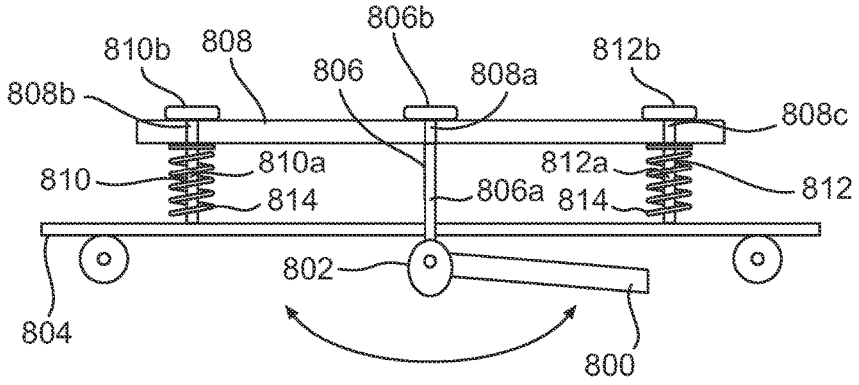
FIG. 11 is a schematic diagram of a retraction and biasing system for a mobile refrigeration cabinet according to one embodiment.

FIG. 11 illustrates another alternative embodiment, in which the rotation of the handle 800 causes a cam 802 to rotate and act on a supporting member 804, which may be the bottom wall of the mobile refrigeration cart 10, thereby forcing a connecting rod 806 attached to the cam 802 to descend. The connecting rod 806 may exit through the bottom of the mobile refrigeration cart 10. The connecting rod 806 includes a connecting portion 806*a* and a flange portion 806*b*. The connecting portion 806*a* is inserted through a plate 808 via a first hole 808*a*, and is engaged to the cam 802. The flange portion 806*b* contacts, and may connect, to the top surface of the plate 808. The plate 808 further includes, at least, a second hole 808*b* and a third hole 808*c* which allow spring connecting rods 810 and 812 to respectively pass through the plate 808. The spring connecting rods 810 and 812 each include connecting portions 810*a* and 812*a* and flange portions 810*b* and 812*b*, respectively. The connecting portions 810*a* and 812*a* are disposed within the springs 814, thereby preventing their lateral movement when they are compressed. The flange portions 810*b* and 812*b* are preferably attached to the plate 808, and may be countersinked thereto to provide a flush top surface of the plate 808. When the connecting rod 806 descends as a result of the operation of the handle 800, the biasing against the plate 808 causes the springs 814 to compress.

The plate 808 may span the width of the non-refrigerated space and be attached to mounting brackets 402 and 404, which in this embodiment are not attached to the side walls 104*a* and 104*b*. Thus, by operation of the handle 800, the mounting brackets may be raised or lowered such that the movable tray 400 is raised or lowered. This embodiment provides additional benefits of reducing the number of individual items that must be manipulated in order to raise or lower the movable tray 400. While only two springs are discussed above, three or more may be provided in addition to corresponding connecting rods.

In yet another alternative embodiment, a plurality of wedges formed from an elastic material may be provided between the bottom wall 150 of the non-refrigerated space 30 and the movable tray 400. The plurality of wedges are configured to move with respect to each other, and engage each other such that a combined structure biases the bottom of the movable tray 400. The wedges may be arranged and disposed on the bottom wall 150 of the non-refrigerated space 30 in numerous positions. Furthermore, the plurality of wedges may engage other structures provided in the non-refrigerated space 30. These other structures may bias the movable tray 400 directly or indirectly in conjunction with, or in place, of the plurality wedges. The motion of the other structures, however, is dependent upon the motion and relative relationships of the plurality of wedges.

In one embodiment, the plurality of wedges may be interconnected by a threaded screw, which extends to the exterior of the mobile refrigeration cabinet 10. The plurality of wedges may be disposed in tracks provided on the bottom wall 150 of the mobile refrigeration cabinet 10, which allow the plurality of wedges to move in a direction orthogonal to the vertical direction. By manipulating the threaded screws from the exterior the plurality of wedges may be advanced relative to each other. If initially one of the plurality of wedges is displaced vertically with respect to the other, then the advancement of the plurality wedges towards each other will cause them to engage in manner which forms a block structure that increases in height as the distance between the plurality of wedges is decreased. As a result, by manipulation of the threaded screws, the movable tray may be biased in the vertical direction.

Figure 12:
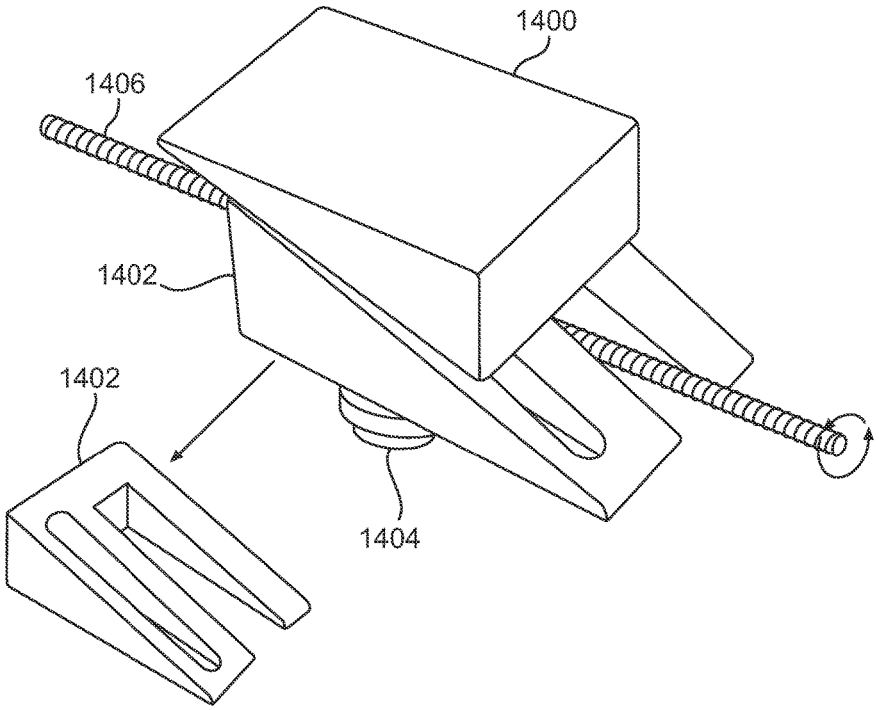
FIG. 12 is an illustration of the engagement of two wedges for a mobile refrigeration cabinet according to one embodiment.

FIG. 12 shows an exemplary wedge embodiment of two wedges 1400 and 1402. The top wedge 1400 slides across the top surface of the wedge 1402 in accordance with the manipulation of a threaded rod 1406. An element 1404 is positioned beneath the wedge 1402 to set a lower height.

Figure 13A:
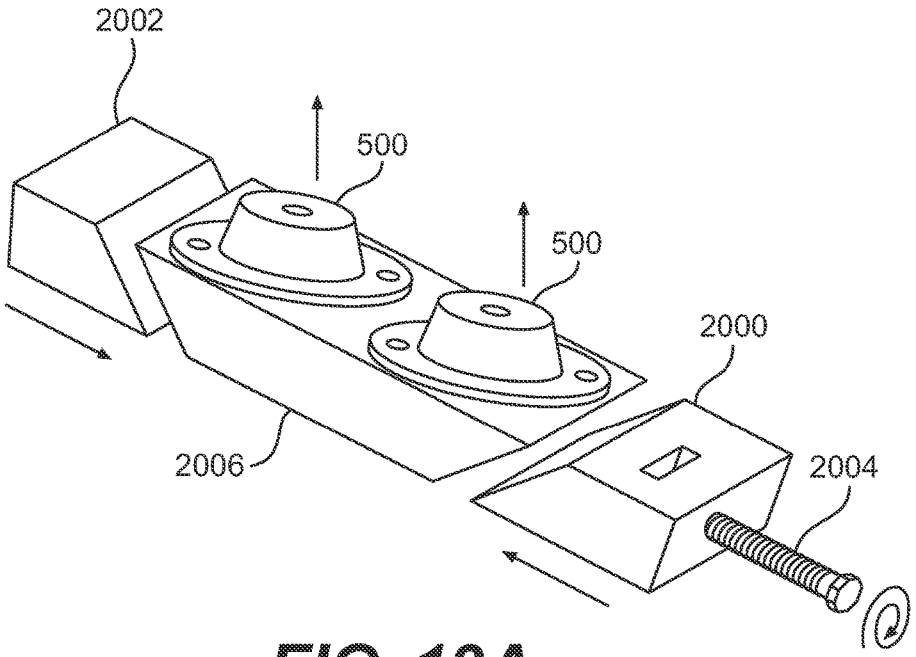
FIG. 13A is an illustration of the engagement of two wedges and an intermediary member for a mobile refrigeration cabinet according to one embodiment.
Figure 13B:
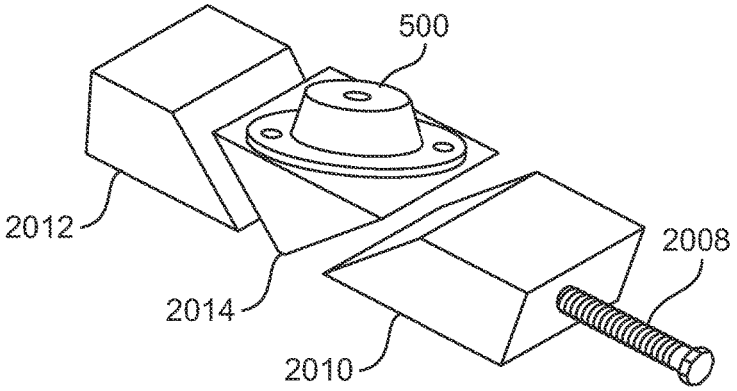
FIG. 13B is an illustration of the engagement of two wedges and an intermediary member for a mobile refrigeration cabinet according to one embodiment.

FIGS. 13A and 13B show two other wedge embodiments, respectively, where wedges engage an intermediary structure. FIG. 13A shows a wedge 2000 and a wedge 2002 engaging an intermediary structure 2006 as a result of the manipulation of a threaded connector 2004. On the top surface of the intermediary structure 2006 are disposed two vibration damping isolators 500. FIG. 13B shows a structure similar to FIG. 13A, including two wedges 2010 and 2012, a threaded connector 2008, and intermediary structure 2014. In FIG. 13B, however, only one vibration damping isolator 500 is disposed on the intermediary structure 2014.

Figure 14:
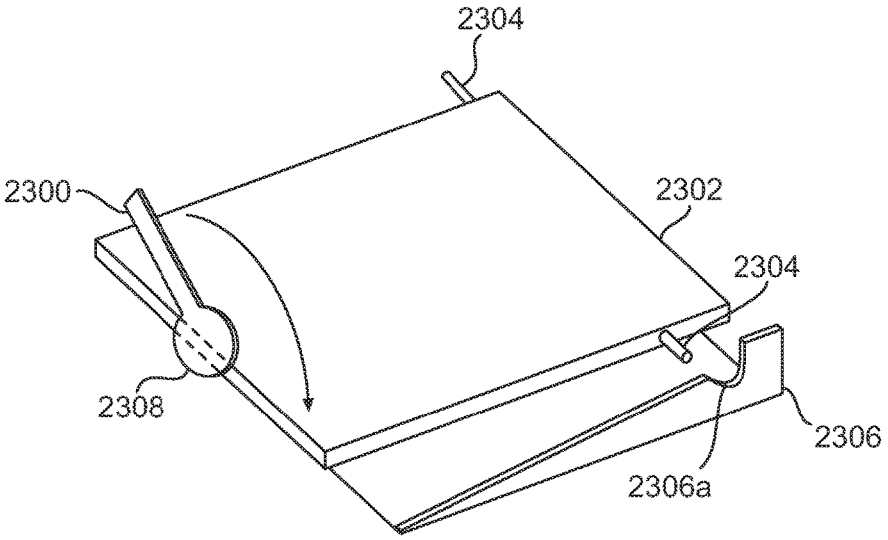
FIG. 14 is an illustration of a cam system for a mobile refrigeration cabinet according to one embodiment.

FIG. 14 shows a handle 2300 which includes a cam 2308. The rotation of the handle 2300 causes the cam 2308 to act against a support element which lifts the handle end of the plate 2302. The plate 2302 includes an engagement 2304 which engages a locking depression 2306*a* formed in a wedge 2306. By rotating the cam 2308 via the handle 2300 with the engagement 2304 engaged with the depression 2306*a*, the plate 2302 is brought to a predetermined height. By rotating the cam 2308 in the opposite direction, the plate 2302 is lowered and can be released by pulling the plate 2302 away from the locking depression 2306*a*.

In another embodiment, a mounting plate is provided onto which the movable tray is mounted. The mounting plate includes a plurality of vibration damping isolators disposed near its corners. In this embodiment, the movable tray includes mounting arms that are configured to engage mounting depressions formed on vertical edges of the mounting plate. The movable tray is also provided with a handle that includes a cam foot. When the handle is rotated, the cam engages an interior portion of the mounting plate, thereby causing the movable tray and the mounting plate to separate. As a result, the mounting arms are dislodge from the mounting depressions, allowing the movable tray to be removed.

Figure 15:
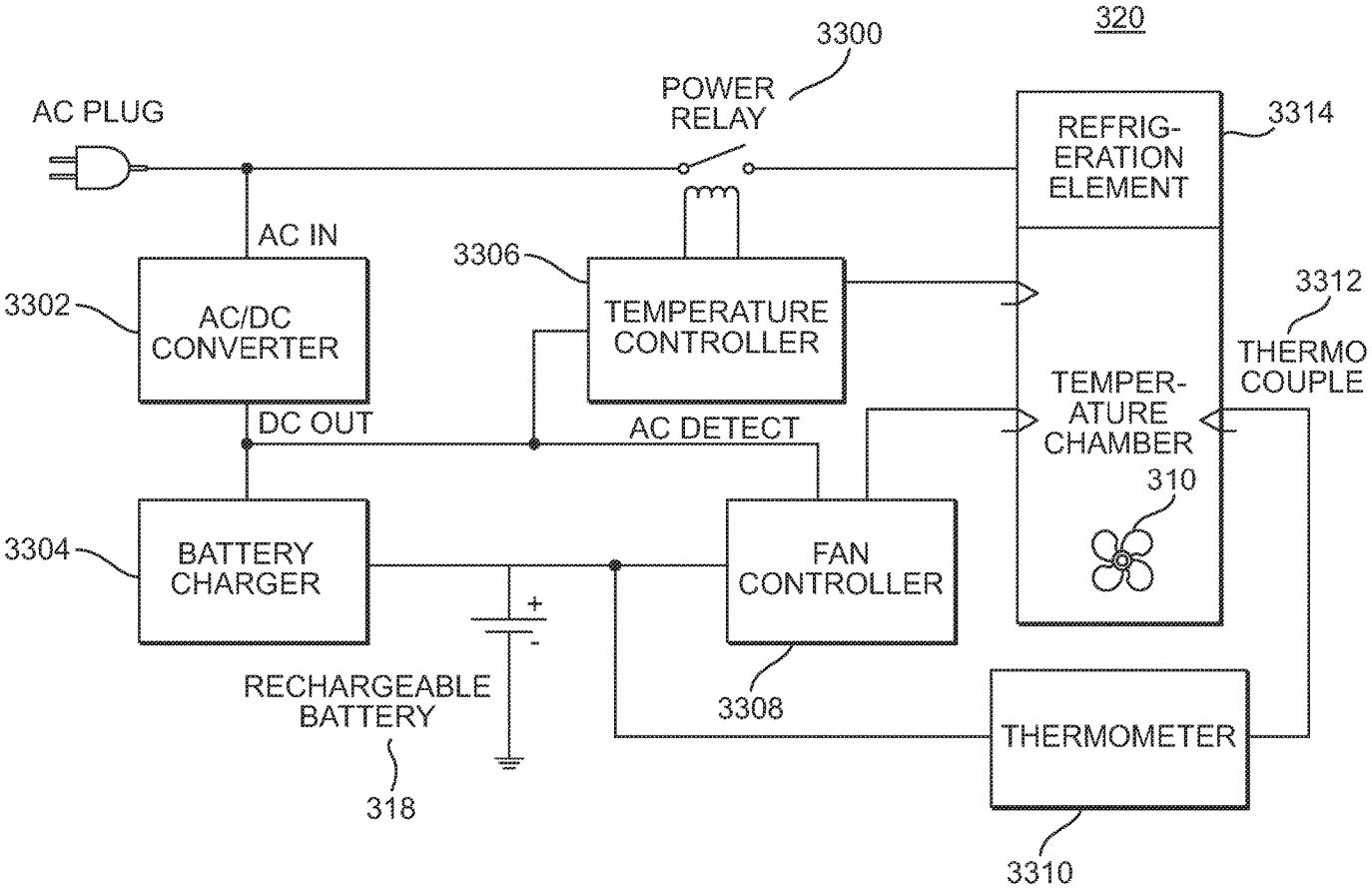
FIG. 15 is an illustration of a control unit for a mobile refrigeration cabinet according to one embodiment.

As discussed above, another feature of the exemplary embodiment is that the refrigeration system 300 may be configured to run in a plurality of modes, including a refrigeration mode and a battery-powered mode, which may be selectable by a user or automatically activated. As described above, the refrigeration system 300 is connected to a control unit 320, shown in FIG. 15. The control unit 320 includes a power relay 3300, which is preferably the power control switch 114*a*, an AC/DC converter 3302 and a battery charger 3304. The AC/DC converter 3302 converts the supplied electrical power from alternating current to direct current which is supplied to the battery charger 3304 to charge the rechargeable battery 318.

Refrigeration System Control

The control unit 320 also includes a temperature controller 3306, a fan controller 3308, and a thermometer 3310. As one of ordinary skill will appreciate, the temperature controller 3306 and fan controller 3308 may also be a single controller. The thermometer 3310 is connected to a thermocouple 3312 which measures the temperature of the refrigerated space 20. The temperature information is sent to the fan controller 3308 and the temperature controller 3306 which, in the refrigeration mode, drives the evaporator fan 310 and refrigeration element 3314, respectively, in accordance with the determined temperature. In one embodiment, when the power control switch 114*a* is toggled, the refrigeration system defaults to an automatic control mode where the refrigeration system 300 is cycled according to the temperature in the refrigerated space and a desired temperature set by the user.

In the automatic control mode, the fan controller 3308 may automatically detect the loss of AC power, and switch the refrigeration system 300 to a battery-powered mode. In a user mode, the refrigeration system 300 may be set to a battery powered mode regardless of the source of power.

When the fan controller 3308 detects the loss of AC power, or the user sets the refrigeration system 300 to a battery powered mode, the fan controller draws power from the battery 318 to run the evaporator fan 310. In a battery powered mode the evaporator fan 310 is preferably set to run at a reduced rate compared to a refrigeration mode, while the refrigeration system 300 does not produce refrigerated air. In an alternate embodiment, however, the user may regulate the speed of the evaporator fan 310, especially when AC power is supplied.

Driving the evaporator fan 310, allows for air within the refrigerated space 20 to be circulated, even though the refrigeration system 300 is not operating, thereby preventing the detrimental effects of stratification discussed above. As a result, the overall temperature within the refrigerated space is relatively homogenous, thus allowing items to be stored within refrigerated space 20 for a longer period of time.

While various example embodiments of the invention have been described above, it should be understood that they have been presented by way of example, and not limitation. It is apparent to persons skilled in the relevant art(s) that various changes in form and detail can be made therein. Thus, the disclosure should not be limited by any of the above described example embodiments.

In addition, it should be understood that the figures are presented for example purposes only. The architecture of the example embodiments presented herein is sufficiently flexible and configurable, such that it may be utilized and navigated in ways other than that shown in the accompanying figures.

What is claimed is:

1. A mobile refrigeration cabinet, comprising:

a refrigerated section;

a non-refrigerated section having a bottom wall and an aperture in a side thereof for accessing the non-refrigerated section;

an opening between the refrigerated section and the non-refrigerated section;

a movable tray disposed in the non-refrigerated section and movable through the aperture;

a refrigeration system comprising a compressor, condenser, evaporator and a fan removably mounted on the movable tray; and a plurality of dampers mounted to the bottom wall and disposed between the bottom wall and the movable tray for reducing the transmission of vibrations from the bottom wall to the refrigeration system and biasing the refrigeration system into sealing engagement with the opening;

wherein each of the dampers comprises:

a mounting member protruding through the bottom wall formed from a deformable elastomeric material and having a threaded aperture extending therethrough;

a threaded bolt engaging the threaded aperture from an underside of the mounting member; and a swivel pad comprising a ball portion attached to a socket portion and a generally planar pad portion;

wherein each of the dampers is movable between an engaged position in which the damper applies a biasing force against the refrigeration system and the pad portion of the swivel pad contacts and remains flush against an underside of the movable tray and a disengaged position in which the damper does not apply the biasing force against the refrigeration system and the swivel pad does not contact the moveable tray; and wherein the biasing force applied by each of the dampers to the refrigeration system can be varied by advancing or retracting the bolt in the threaded aperture in the mounting member of each of the dampers.

2. The mobile refrigeration cabinet according to claim 1, further comprising:

a rechargeable battery; and a controller comprising an AC/DC converter and a battery charger operably connected to the rechargeable battery;

wherein the controller enables the refrigeration system to operate in both a battery powered mode, wherein electrical power is provided to the refrigeration system from the battery, and a non-battery powered mode, wherein electrical power is provided to the refrigeration system from a power source external to the mobile refrigeration cabinet;

wherein in the battery powered mode, the refrigeration system does not produce refrigerated air and the fan circulates air contained within the refrigerated section; and wherein in the non-battery powered mode, the refrigeration system produces refrigerated air and the fan circulates the refrigerated air within the refrigerated section.

3. The mobile refrigeration cabinet according to claim 2, wherein the controller further comprises:

a switch which is operable by a user for causing the refrigeration system to operate in the battery powered mode.

4. The mobile refrigeration cabinet according to claim 2, wherein the controller further comprises a fan controller for operating the fan, detecting whether the power source external to the mobile refrigeration cabinet is not present, and causing the refrigeration system to operate in the battery powered mode when the power source external to the mobile refrigeration cabinet is not present.

5. The mobile refrigeration cabinet according to claim 4, wherein the fan operates at a first rate in the battery powered mode and at a second rate in the non-battery powered mode;

wherein the first rate is less than the second rate.

6. The mobile refrigeration cabinet according to claim 5, wherein the controller further comprises:

a switch which operable by a user for causing the refrigeration system to operate in the battery powered mode.

7. A mobile refrigeration cabinet, comprising:

a refrigerated section;

a non-refrigerated section having a bottom wall and an aperture in a side thereof for accessing the non-refrigerated section;

an opening between the refrigerated section and the non-refrigerated section;

a movable tray disposed in the non-refrigerated section and movable through the aperture;

a refrigeration system comprising a compressor, condenser, evaporator and a fan removably mounted on the movable tray; and a plurality of dampers mounted to the bottom wall and biasing the movable tray and the refrigeration system toward the opening between the refrigerated section and the non-refrigerated section such that the refrigeration system is sealingly engaged with the opening, each damper comprising a compression spring and a generally planar pad;

wherein each of the dampers is movable between a first position in which the damper applies a biasing force against the movable tray and the refrigeration system and the pad contacts and remains flush against an underside of the movable tray and a second position in which the damper is compressed; and a compression mechanism for selectively overcoming the bias of the dampers against the movable tray and the refrigeration system, the compression mechanism comprising a rotatable handle, a cam directly attached to the handle for rotation with the handle and an intermediary cam follower component connected to the moveable tray, wherein upon rotation of the handle the cam and cam follower component are configured to overcome the biasing force of each of the dampers and move each damper to the second position enabling the refrigeration system to disengage from the opening.

8. The mobile refrigeration cabinet according to claim 7, further comprising first and second mounting brackets attached to opposing interior side walls of the non-refrigerated section and configured to support the movable tray and the refrigeration system when the dampers are in the disengaged position.

9. The mobile refrigeration cabinet according to claim 7, further comprising:

a rechargeable battery; and a controller comprising an AC/DC converter and a battery charger operably connected to the rechargeable battery;

wherein the controller enables the refrigeration system to operate in both a battery powered mode, wherein electrical power is provided to the refrigeration system from the battery, and a non-battery powered mode, wherein electrical power is provided to the refrigeration system from a power source external to the mobile refrigeration cabinet;

wherein in the battery powered mode, the refrigeration system does not produce refrigerated air and the fan circulates the air contained within the refrigerated section; and wherein in the non-battery powered mode, the refrigeration system produces refrigerated air and the fan circulates the refrigerated air within the refrigerated section.

10. The mobile refrigeration cabinet according to claim 9, wherein the controller further comprises:

a switch which is operable by a user for causing the refrigeration system to operate in the battery powered mode.

11. The mobile refrigeration cabinet according to claim 9, wherein the controller further comprises a fan controller for operating the fan, detecting whether the power source external to the mobile refrigeration cabinet is not present, and causing the refrigeration system to operate in the battery powered mode when the power source external to the mobile refrigeration cabinet is not present.

12. The mobile refrigeration cabinet according to claim 11, wherein the fan operates at a first rate in the battery powered mode and at a second rate in the non-battery powered mode;

wherein the first rate is less than the second rate.

13. The mobile refrigeration cabinet according to claim 12, wherein the controller further comprises:

a switch which operable by a user for causing the refrigeration system to operate in the battery powered mode.

* * * * *